US006499453B1

(12) United States Patent
Immel et al.

(10) Patent No.: US 6,499,453 B1
(45) Date of Patent: Dec. 31, 2002

(54) MID CAM ENGINE

(75) Inventors: Thomas A. Immel, Malone, WI (US); Gar M. Adams, Chilton, WI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 09/699,549

(22) Filed: Oct. 30, 2000

(51) Int. Cl.[7] ..... F01L 1/02

(52) U.S. Cl. ..... 123/90.31; 123/90.27; 123/90.44; 123/90.6

(58) Field of Search ..... 123/90.31, 90.1, 123/90.16, 90.17, 90.27, 90.39, 90.44, 90.6, 193.5, 193.2, 195 C, 196 R, 196 W, 198 E, 198 F

(56) References Cited

U.S. PATENT DOCUMENTS

| | | | | |
|---|---|---|---|---|
| 1,087,803 | A | 2/1914 | Melling | |
| 1,244,481 | A | 10/1917 | Duesenberg et al. | |
| 1,267,337 | A | 5/1918 | Huebotter | |
| 1,293,712 | A | 2/1919 | Church | |
| 1,311,060 | A | 7/1919 | Felix | |
| 1,315,788 | A | 9/1919 | Murray | |
| 1,351,950 | A | 9/1920 | Gaston | |
| 1,464,282 | A | 8/1923 | Klossner | |
| 1,507,666 | A | 9/1924 | Davis | |
| 1,521,440 | A | 12/1924 | Foster | |
| 1,656,065 | A | 1/1928 | Heinemann | |
| 3,650,250 | A | 3/1972 | Lohr et al. | 123/41.69 |
| 3,757,749 | A | 9/1973 | Hatz | 123/90.22 |
| 4,216,746 | A | 8/1980 | Freyn | 123/41.69 |
| 4,396,407 | A | 8/1983 | Reese | 55/319 |
| 4,603,663 | A | 8/1986 | Giocastro | 123/90.17 |
| 4,662,328 | A | 5/1987 | Kronich | 123/198 C |
| 4,697,555 | A | 10/1987 | Fujikawa et al. | 123/90.23 |
| 4,716,861 | A | 1/1988 | Fujikawa et al. | 123/90.2 |
| 4,762,098 | A | 8/1988 | Tamba et al. | 123/90.33 |
| 4,922,863 | A * | 5/1990 | Adams | 123/193.2 |
| 4,969,434 | A | 11/1990 | Nakagawa | 123/196 M |
| 5,000,126 | A | 3/1991 | Isaka et al. | 123/41.65 |
| 5,058,542 | A | 10/1991 | Grayson et al. | 123/90.38 |
| 5,176,116 | A | 1/1993 | Imagawa et al. | 123/196 W |
| 5,213,074 | A | 5/1993 | Imagawa et al. | 123/196 M |
| 5,233,967 | A | 8/1993 | Peller | 123/572 |
| 5,243,936 | A | 9/1993 | Kobayashi | 123/188.14 |

(List continued on next page.)

FOREIGN PATENT DOCUMENTS

| | | |
|---|---|---|
| WO | WO 01/61153 | 8/2001 |
| WO | WO 01/61157 | 8/2001 |

*Primary Examiner*—Teresa Walberg
*Assistant Examiner*—Fadi H. Dahbour
(74) *Attorney, Agent, or Firm*—Baker & Daniels

(57) ABSTRACT

A drive train for an overhead valve engine, including a cam gear driven by the crankshaft, the cam gear supported for rotation in the cylinder block externally of the cylinder head and having a cam lobe mounted thereon for actuating a pair of rocker arms mounted for rotation in the cylinder head, which in turn actuates intake and exhaust valves in the cylinder head. A first lubrication passageway is provided in the crankcase of the engine to communicate oil, pumped from the oil sump by a combination oil pump and governor assembly driven from the crankshaft, to the upper crankshaft bearing. A second lubrication passageway is provided in the crankshaft and communicates oil from the upper crankshaft bearing to the coupling between the crankshaft and the connecting rod. An air cleaner body includes an integrally formed fitting extending therefrom, which fits within an opening in the breather cover to directly communicate the breather chamber with the air cleaner, wherein the air cleaner body may be mounted to the cylinder block in an easy, one-step operation in which the fitting is inserted into the breather cover opening and the air cleaner body is fastened directly to a mounting flange of the carburetor.

23 Claims, 16 Drawing Sheets

U.S. PATENT DOCUMENTS 5,293,847 A * 3/1994 Hoffman et al. ..... 123/90.6
5,421,292 A 6/1995 Hoffman et al. ..... 123/41.69
5,421,297 A 6/1995 Tamba et al. ..... 123/193.5
5,564,374 A 10/1996 Hoffman et al. ..... 123/90.23
5,588,408 A 12/1996 Kurihara ..... 123/196 W
5,606,943 A 3/1997 Tamba et al. ..... 123/90.23
5,606,944 A * 3/1997 Kurihara ..... 123/90.31
5,706,769 A 1/1998 Shimizu ..... 234/90.23
5,755,194 A * 5/1998 Moorman et al. ..... 123/196 W
5,857,441 A 1/1999 Yonezawa et al. ..... 123/196 R
5,884,593 A * 3/1999 Immel et al. ..... 123/90.27
5,937,816 A 8/1999 Wincewicz et al. ..... 123/195 A
5,937,836 A 8/1999 Yonezawa et al. ..... 123/572
5,947,070 A * 9/1999 Immel et al. ..... 123/90.6
5,979,392 A * 11/1999 Moorman et al. ..... 123/196 W
5,988,135 A * 11/1999 Moorman et al. ..... 123/196 W
6,032,635 A * 3/2000 Moorman et al. ..... 123/196 R
6,039,020 A 3/2000 Kawamoto et al. ..... 123/196 R
6,223,713 B1 * 5/2001 Moorman et al. ..... 123/196 R
6,276,324 B1 * 8/2001 Adams et al. ..... 123/90.27
6,279,522 B1 * 8/2001 Balzar et al. ..... 123/90.1
6,349,688 B1 2/2002 Gracyalny et al. ..... 123/90.39

* cited by examiner

MID CAM ENGINE

BACKGROUND OF THE INVENTION

1. Field of the Invention

The field of the present invention relates to overhead valve engines for use in a variety of applications, such as walk behind lawnmowers, lawn and garden implements, or in small utility vehicles such as riding lawnmowers, lawn tractors, and the like.

2. Description of the Related Art

Prior known engines having drive trains of an overhead valve design are well known in the art. For example, in one known arrangement, a crankshaft drives a camshaft, located in the crankcase, through a gear set. The camshaft includes one or more lobes which actuate a pair of cam followers mounted for rotation on a cam follower shaft. The cam followers in turn actuate push rods extending from the crankcase to the cylinder head for rotating a pair of rocker arms mounted in the cylinder head to open and close the intake and exhaust valves.

In another known arrangement, a camshaft located within the cylinder head is driven from the crankshaft by means of a belt, chain, or the like. The camshaft includes one or more lobes that actuate the intake and exhaust valves either directly, or through a pair of rocker arms rotatably mounted in the cylinder head.

A disadvantage with the first arrangement is that the several components of the valve train, including the camshaft, cam lobes, cam follower shaft, cam followers, push rods, and rocker arms tend both to increase the inertial forces of the valve train and increase the overall size of the engine. The several components also increase the cost and complexity of the engine, the difficulty of assembly thereof, and the likelihood of failure of one of the components.

A disadvantage of the second arrangement is that locating the camshaft in the cylinder head does not allow for a compact engine design. Specifically, such an arrangement increases the width of the cylinder head due to the lateral space between cam lobes and/or between a cam lobe and the pulley or sprocket which is mounted on the camshaft and driven from the crankshaft. The location of the camshaft directly above the valves, when the camshaft actuates the valves directly, also increases the height of the cylinder head. In addition, the height of the cylinder head is further increased to accommodate the relatively large pulley or sprocket mounted on the camshaft which is necessary for speed reduction. Further, the belt, chain or the like which drives the camshaft in the crankshaft is prone to wearing or breakage.

Often, such engines include a pressure lubrication system to bring oil into contact with moving the parts in the engine crankcase. Alternatively, a splasher or other agitator driven from the crankshaft splashes oil in the oil sump to create an oil mist in the crankshaft of the engine. Pressure and turbulence in the crankcase caused by the reciprocating piston bring the oil mist into contact with the crank flywheel bearing, the coupling between the connecting rod and the crankshaft, and other components which require lubrication yet are not in contact with the oil sump. Also, splashed oil may contact such components in a random fashion to lubricate same. However, such a lubrication arrangement does not allow for the continuous and direct lubrication by liquid oil of the engine components which are not in contact with the oil sump, especially components which are located substantially above the oil sump. Problematically, such components are substantially unlubricated during the time immediately following engine startup, before an adequate oil mist can be generated in the crankcase and brought into contact with such components, or before sufficient time has elapsed for oil splash to lubricate such components. Also, in engines which include plunger oil pumps, it is desired to supply a greater amount of pressurized oil to components therein which require lubrication than the amount supplied by the plunger oil pumps in such engines.

In known engine designs, exhaust blow-by gases from the engine crankcase are either discharged through a breather into the atmosphere, or communicated to an air cleaner through a hose connecting the breather to the air cleaner, and communicated to the carburetor through a second hose connected to the air cleaner and the carburetor. Disadvantageously, this arrangement requires a hose, hose fittings located on each of the breather cover of the breather, the air cleaner, and the carburetor, as well as a number of hose clamps for securing the hoses to the fittings.

What is needed is a drive train for an engine which is compact, such that the drive train may allow a smaller engine height and width, and an overall reduced engine profile.

A further need is for a drive train for an engine, where the drive train is simplified, and includes a minimum number of components.

An additional need is for a method of more effectively directly and continuously lubricating by liquid oil moving parts in the crankcase which are located externally of the oil sump, to ensure direct and effective lubrication of such parts as soon as possible after engine startup, and during the running of the engine.

A further need is for a simplified air cleaner assembly which reduces the number of necessary components, as well as the difficulty of assembly, associated with attaching the air cleaner assembly to the breather cover and to the carburetor.

SUMMARY OF THE INVENTION

The present invention provides a drive train for an overhead valve engine, including a cam gear driven by the crankshaft, the cam gear supported for rotation in the cylinder block externally of the cylinder head and having a cam lobe mounted thereon for actuating a pair of rocker arms mounted for rocking motion in the cylinder head, which in turn actuate intake and exhaust valves in the cylinder head. The cam gear may be supported for rotation within a gear pocket located externally of the cylinder head, the gear pocket integral with the cylinder block and located radially adjacent the cylinder bore.

Advantageously, mounting the cam gear externally of the cylinder head allows the cam gear to be located within the gear pocket adjacent the cylinder bore and externally of the cylinder head, resulting in a reduced overall engine profile and a more compact engine design. The rocker arms include cam follower arms which extend into the gear pocket to engage the cam lobe at respective locations thereof which are located within the gear pocket and spaced opposite the crankshaft.

Additionally, a combination oil pump and governor assembly is driven from the crankshaft, and pumps oil through a first lubrication passageway provided in the crankcase of the engine to communicate oil to an oil seal around the upper crankshaft bearing. A second lubrication passageway provided in the crankshaft communicates oil from the oil seal around the upper crankshaft bearing to the coupling between the crankshaft and the connecting rod.

The combination oil pump and governor assembly supplies pumped oil directly to the moving parts within the crankcase, and advantageously, incorporates both the oil pump and governor into a single assembly, thereby reducing the number of engine components and also obviating the need for further engine space to accommodate separate oil pump and governor assemblies.

An air cleaner body is provided, having an integral fitting extending therefrom which fits within an opening in the breather cover to directly communicate the breather chamber with the air cleaner. Advantageuosly, the air cleaner body may be mounted to the cylinder block in an easy, one-step operation in which the fitting is inserted in to the breather cover opening and the air cleaner body is fastened directly to a mounting flange of the carburetor, thereby facilitating easier assembly and obviating the need for additional components such as hoses, hose fittings on each of the breather cover, air cleaner, and carburetor, and hose clamps.

In one form thereof, an internal combustion engine is provided, including a crankshaft, connecting rod, piston assembly, the piston reciprocating within a cylinder bore in a cylinder block connected to a cylinder head; a cam gear driven by the crankshaft and supported for rotation within the cylinder block externally of the cylinder head, the cam gear having at least one cam lobe mounted thereon for rotation with the cam gear; drive linkage between the crankshaft and the cam gear; and a pair of rocker arms mounted for rotation in the cylinder head for actuating a pair of valves, each rocker arm including a cam follower arm extending therefrom, the cam follower arms engaging the at least one cam lobe.

In another form thereof, an internal combustion engine is provided, including a crankcase connected to a cylinder block, the crankcase having an oil sump therein; a crankshaft journalled in first and second bearings in the crankcase; a connecting rod coupled at opposite ends thereof to the crankshaft and to a piston, the piston reciprocating within the cylinder block; a first passage disposed within the crankcase, the first passage communicating the oil sump with one of the first and second bearings; and a combination oil pump and governor assembly driven from the crankshaft and pumping oil from said oil sump through the first passage.

In still another form thereof, an internal combustion engine is provided, including a cylinder block; a breather cover having an opening therein, the breather cover attached to the cylinder block, the cylinder block and the breather cover defining a breather chamber therebetween; an air cleaner body attached to the breather cover, the air cleaner body including a fitting integrally formed therewith, the fitting extending into the opening to communicate the breather chamber to the air cleaner body.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION

Figure 3:
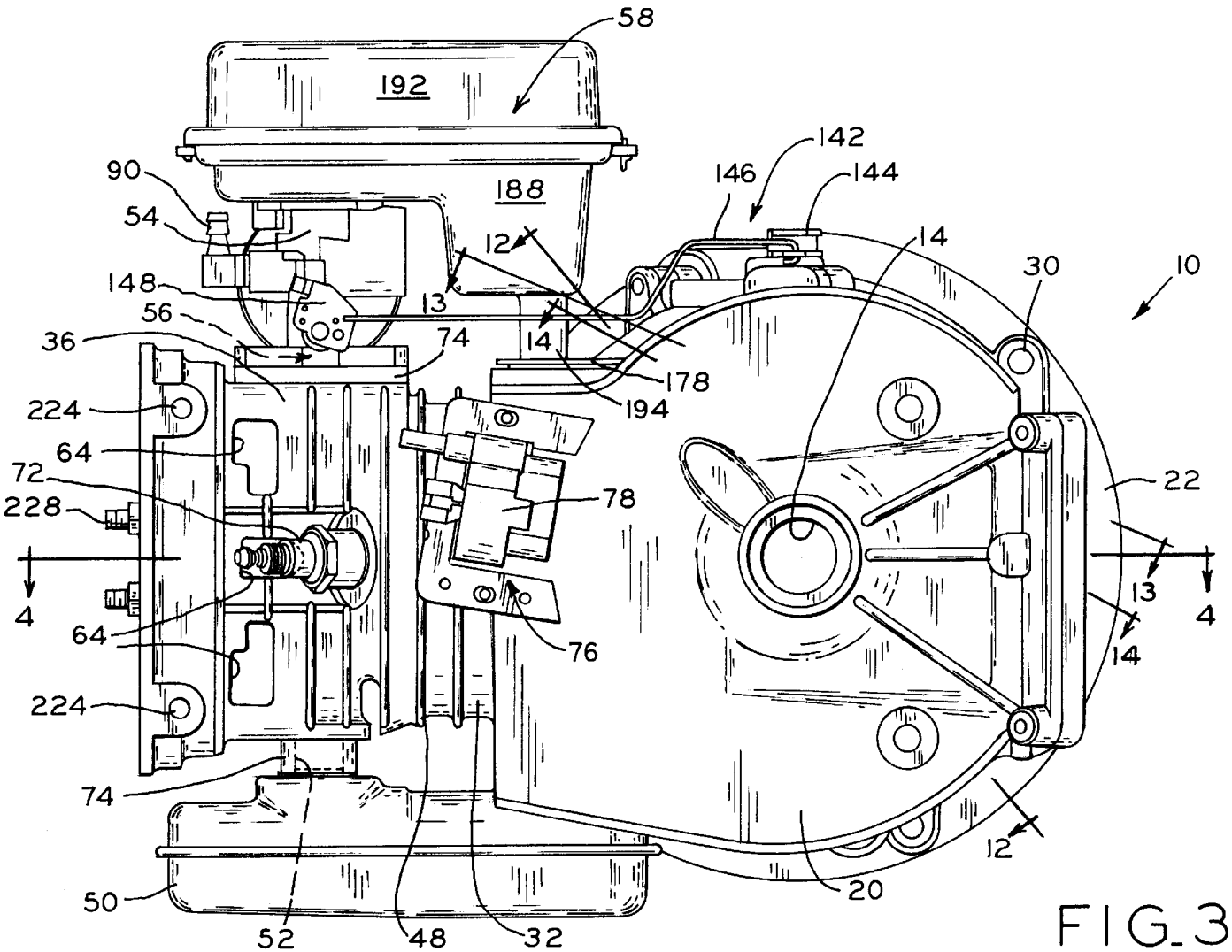
FIG. 3 is a top plan view of the engine of FIGS. 1–2, showing the upper crankshaft bearing, air cleaner, carburetor, governor linkage, and muffler.
Figure 4:
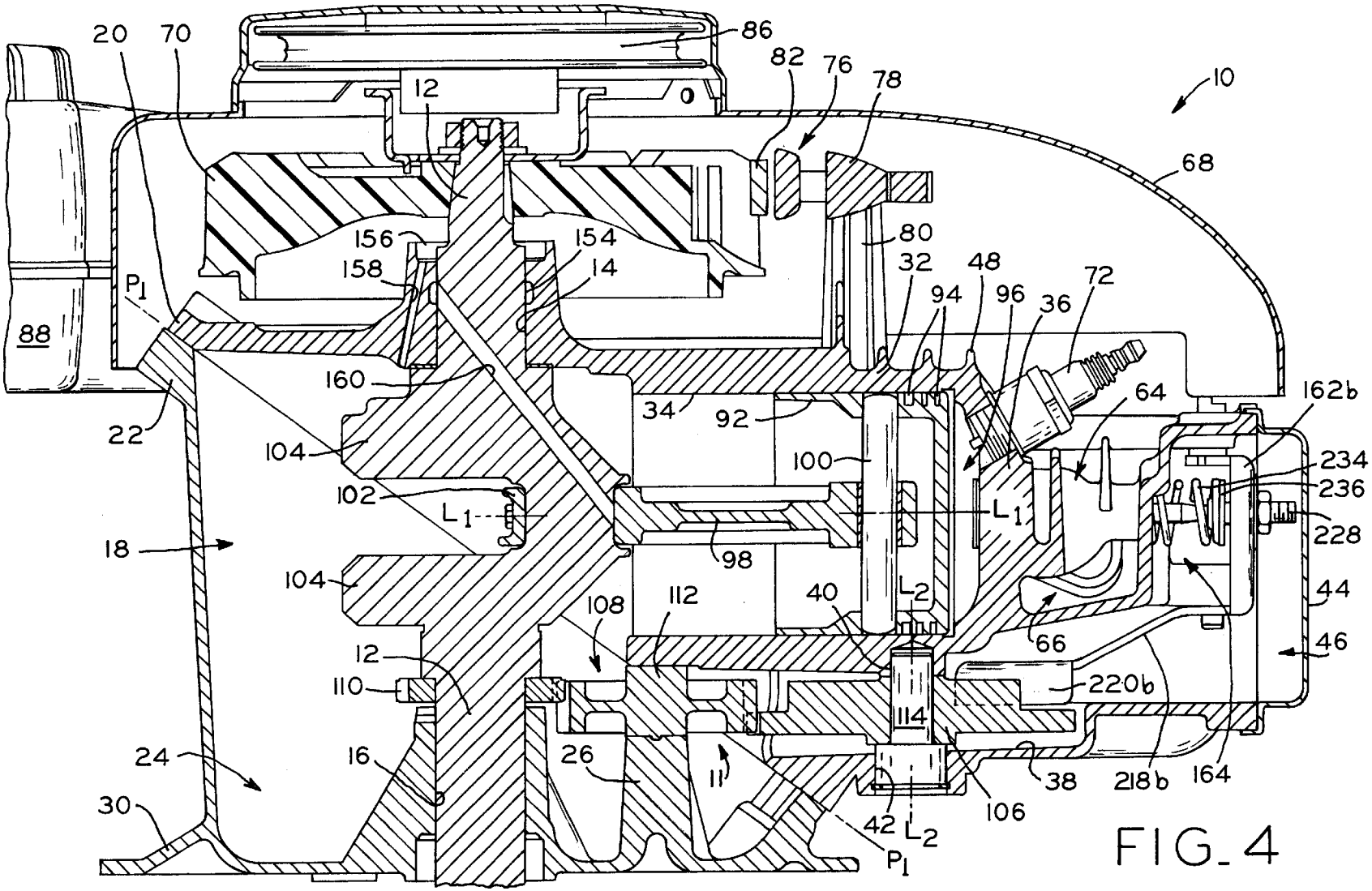
FIG. 4 is a vertical sectional view taken along line 4—4 of FIG. 3, viewed in the direction of the arrows, showing the crankshaft, drive gear, intermediate gear, and cam gear.
Figure 5:
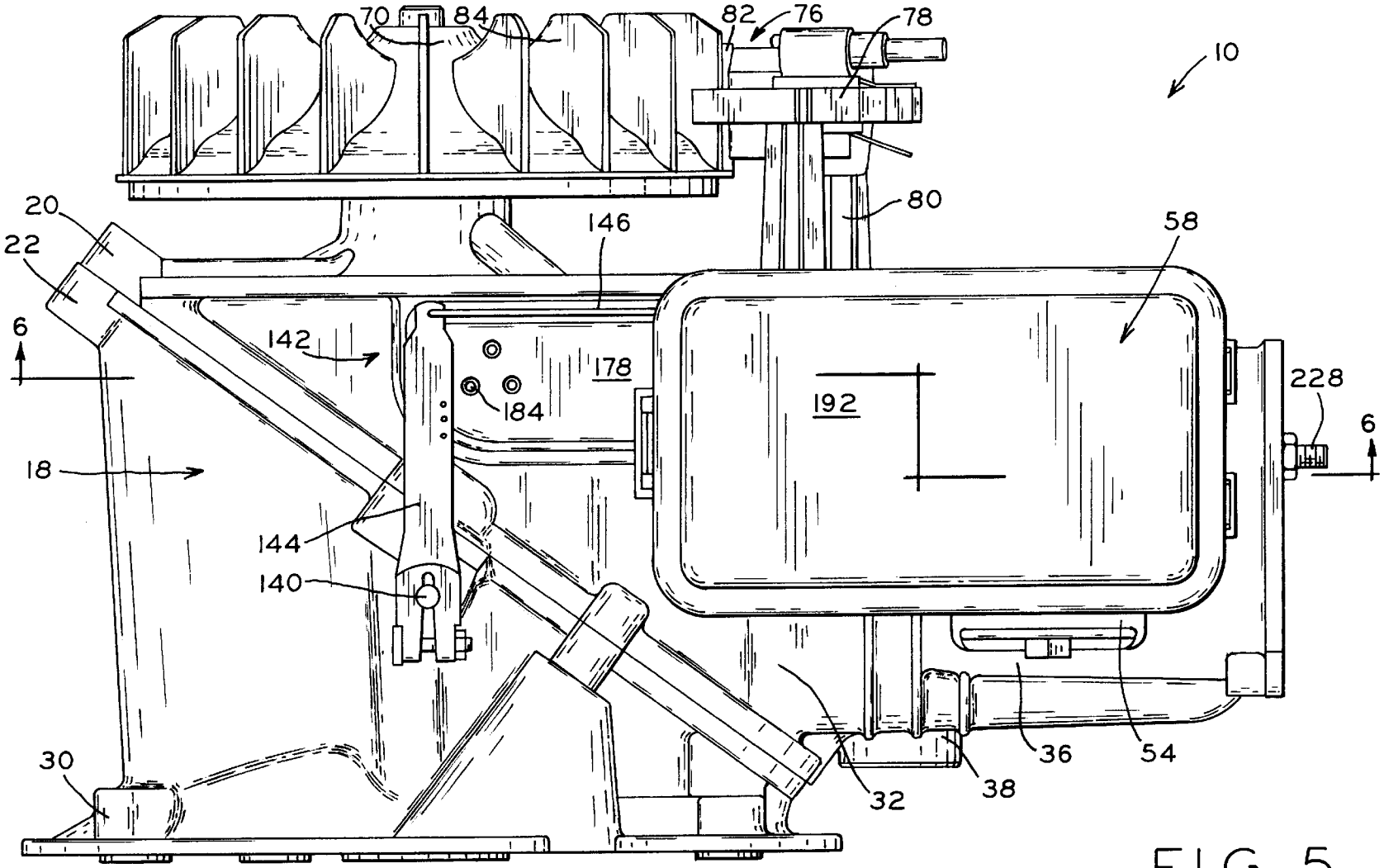
FIG. 5 is a side elevational view, showing the interface between the mounting flange and cylinder casings, as well as the flywheel, governor linkage, and air cleaner.

Referring to FIGS. 1–6, overhead valve engine 10 is shown, orientated such that crankshaft 12 is disposed vertically for a vertical shaft application. However, engine 10 may also be oriented such that crankshaft 12 is disposed horizontally for a horizontal shaft application with minor modifications thereto, as is known in the art. Referring to FIG. 4, engine 10 includes crankcase 18, which is split along plane $P_1$—$P_1$, forming an acute angle to crankshaft 12 such that opposite ends of crankshaft 12 are each journalled in full bearings 14, 16 with upper crankshaft bearing 14 carried in cylinder casing 20 and lower crankshaft bearing 16 carried in mounting flange casing 22.

Figure 16:
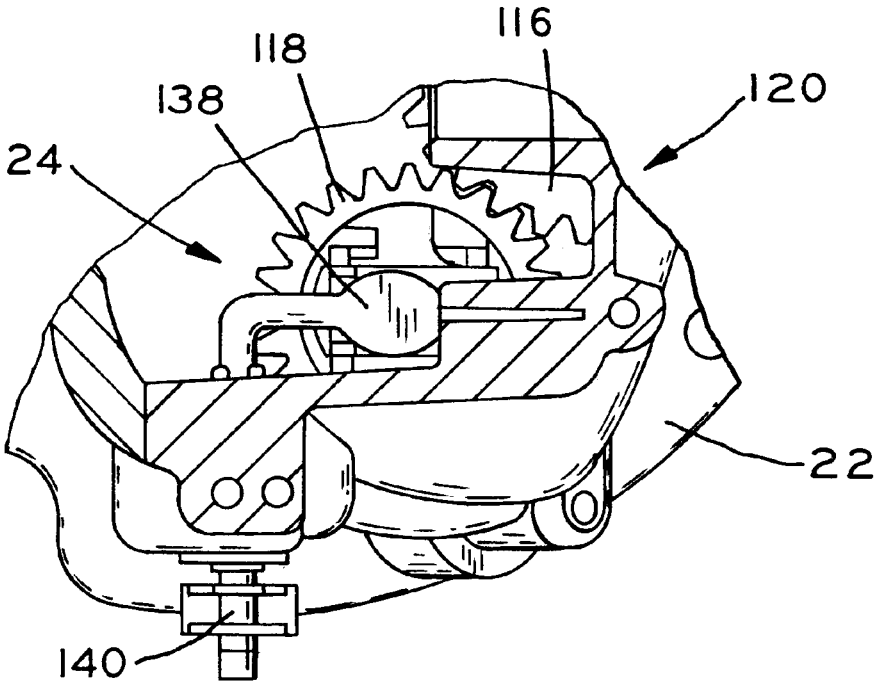
FIG. 16 is a partial fragmentary view, showing the combination oil pump and governor assembly.

Mounting flange casing 22 includes lower crankshaft bearing 16, oil sump 24, intermediate shaft support 26, and oil pump housing (FIG. 16). Mounting flange casing 22 also includes integral mounting flange 30, which may be mounted to a lawnmower for example, in a conventional manner. Cylinder casing 20 includes upper crankshaft bearing 14, cylinder block 32 having cylinder bore 34 therein, integral cylinder head 36 axially adjacent cylinder block 32, integral gear pocket 38 adjacent cylinder block, and upper and lower camshaft bearings 40, 42. A rocker box cover 44 (FIG. 4) covers cylinder head 36, and together with cylinder head 36, defines rocker box 46. Cylinder block 32 and cylinder head 36 include integral cooling fins 48.

Figure 1:
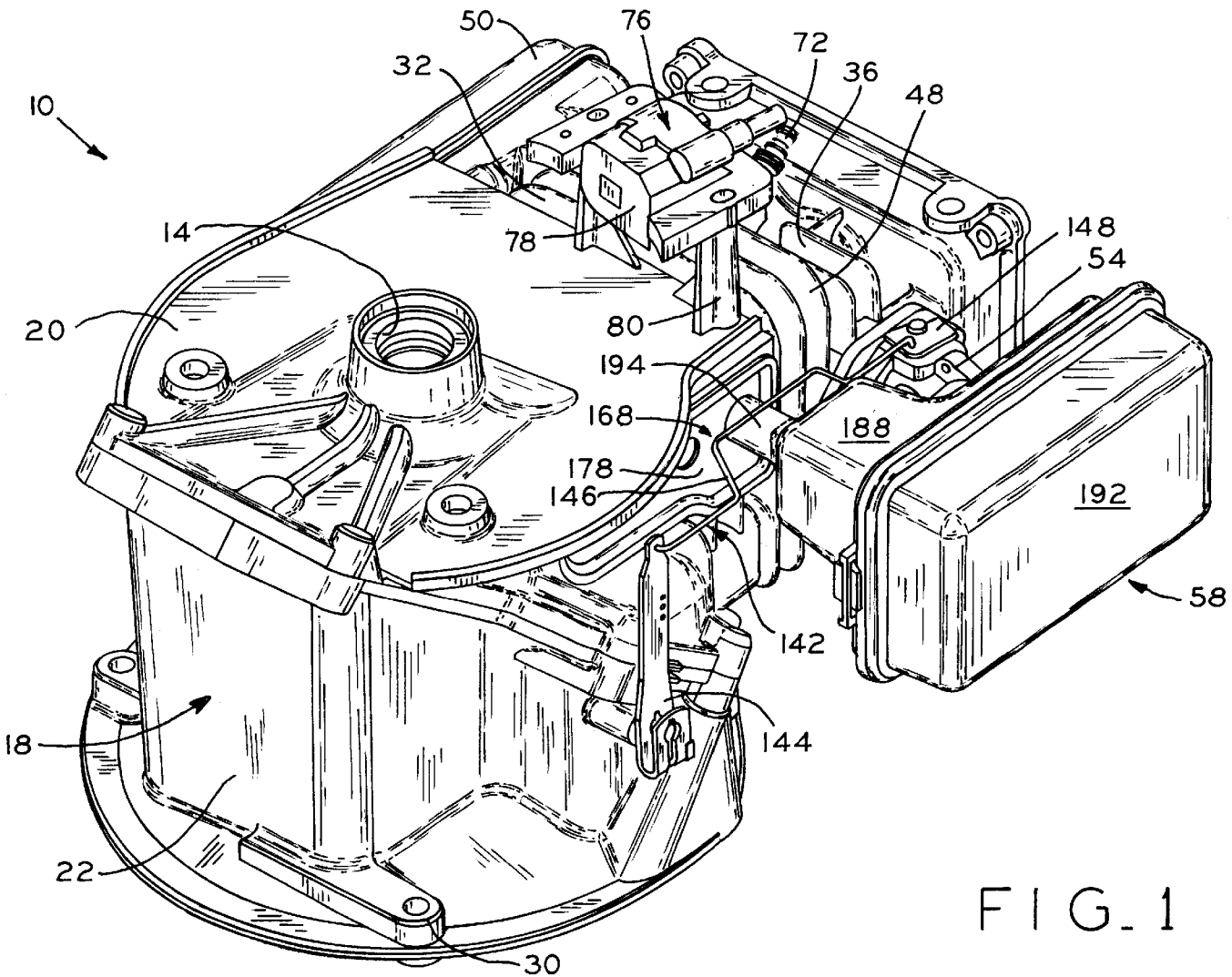
FIG. 1 is an isometric view of an overhead valve engine, showing the muffler, carburetor, and the air cleaner assembly in accordance with the present invention.
Figure 2:
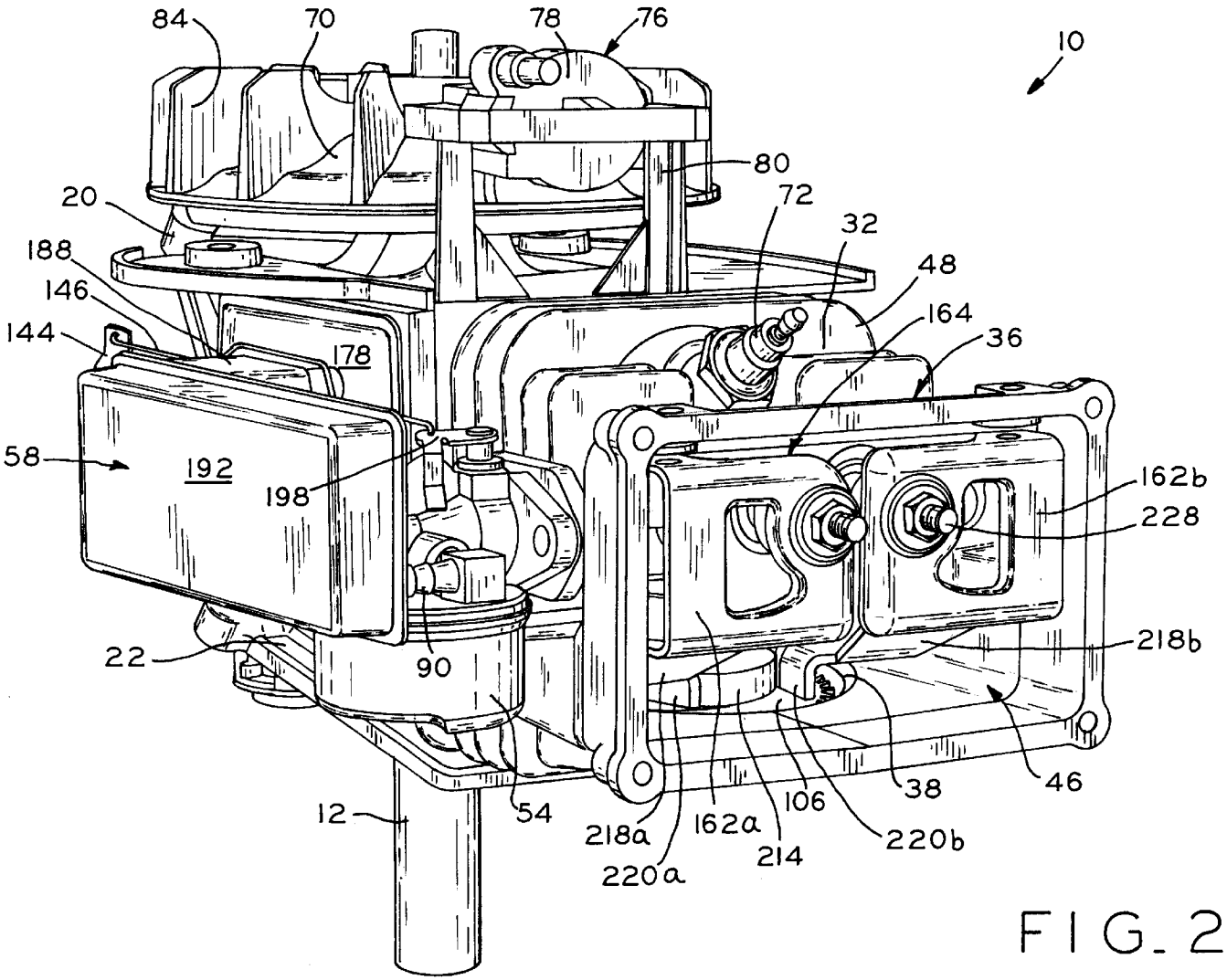
FIG. 2 is an isometric view of the engine of FIG. 1, showing the flywheel, air cleaner assembly, carburetor, cylinder head with rocker arms therein, and part of the drive train.
Figure 6:
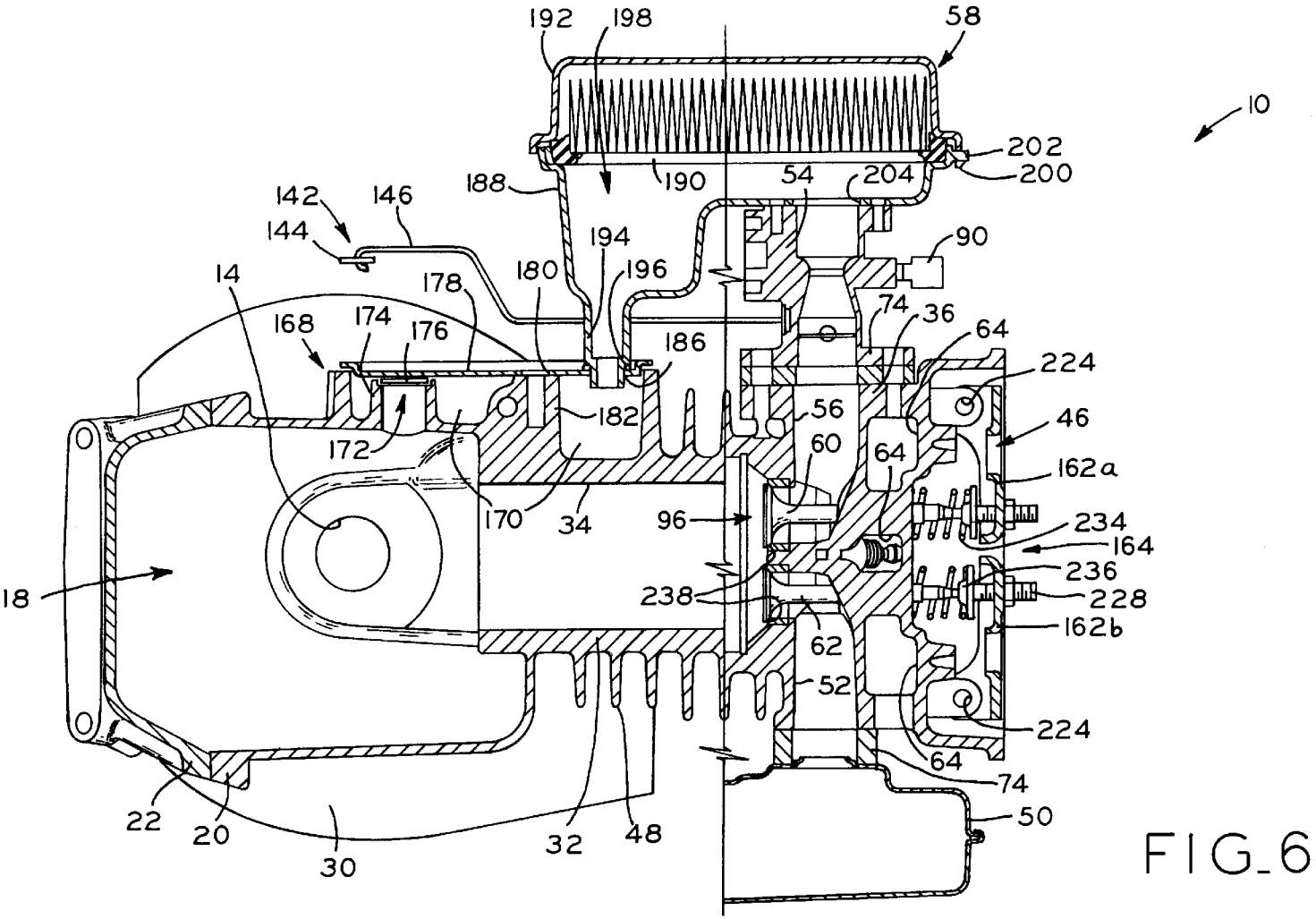
FIG. 6 is a horizontal sectional view taken along line 6—6 of FIG. 5, viewed in the direction of the arrows.

Referring to FIGS. 1, 3, and 6, muffler 50 is attached to exhaust port 52, and carburetor 54 is attached to intake port 56. As shown in FIG. 6, intake port 56 and exhaust port 52 extend inwardly into opposite sides of cylinder head 36 in a cross-flow orientation, which orientation allows the runner length of intake port 56 and exhaust port 52 to be minimized, and also allows muffler 50 to be located on the opposite side of cylinder head 36 from carburetor 54 and air cleaner assembly 58. Intake and exhaust valves 60, 62 are disposed in a plane parallel with piston axis $L_1$—$L_1$, as shown in FIG. 4.

Figure 15:
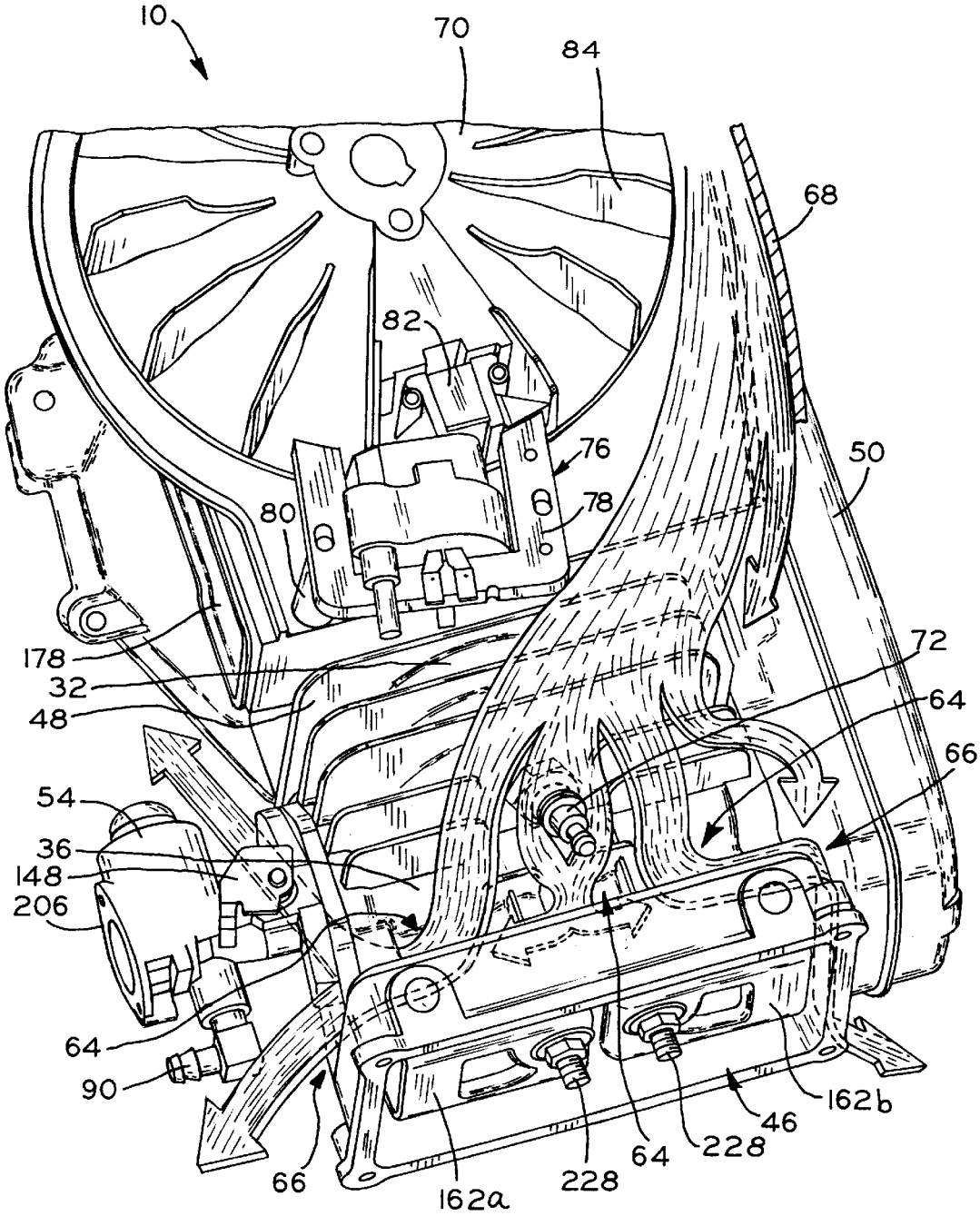
FIG. 15 is an isometric view, showing schematically the paths of cooling air from the flywheel.

As shown in FIGS. 3, 6 and 15, cylinder head 36 further includes three air passageways 64 therethrough, one disposed between intake and exhaust valves 60, 62 and the others disposed respectively on opposite sides of intake and exhaust valves 60, 62. As shown in FIG. 4, a lateral air passageway 66 extends through cylinder block 32 between cylinder head 36 and gear pocket 38 and communicates with passageways 64. Referring to FIG. 15, it may be seen that blower housing 68 directs cooling air from flywheel 70 around spark plug 72 and into contact with cylinder head 36 at a portion thereof in which intake and exhaust valves 60, 62 are disposed. The cooling air then passes through passageways 64 and into contact with gear pocket 38, where the cooling air is then deflected by gear pocket 38 to laterally exit cylinder block 32 through either side of lateral passageway 66 at respective locations near muffler 50 and carburetor 54. As the cooling air exits cylinder block 32, the cooling air cools rocker box 46, reducing the amount of coking and burnt oil inside rocker box 46, which in turn lowers the temperature of the oil within the oil sump 24, to which oil from rocker box 46 returns during the lubrication of engine 10, as described below.

As shown in FIGS. 3 and 6, spacers 74, disposed respectively between cylinder head 36 and each of muffler 50 and carburetor 54 allow cooling air to pass therebetween upon exiting lateral passageway 66, and also provide insulation between cylinder head 36 and each of carburetor 54 and muffler 50.

Referring to FIGS. 1–5, an electronic ignition assembly 76 includes electronic ignition module 78 mounted to supports 80 extending from cylinder block 32. Electronic ignition module 78 is connected to a spark plug cap (not shown) enclosing spark plug 72 by a lead (not shown). Flywheel 70 is secured to one end of crankshaft 12 in a conventional manner, and includes permanent magnet 82 disposed between a pair of flywheel fins 84. As shown in FIG. 4, recoil starter 86 with a pull handle (not shown) is connected to blower housing 68 and is also operatively secured to one end of crankshaft 12 in a conventional manner. Fuel tank 88 is connected to blower housing 68 in a conventional manner, and connected to fuel inlet 90 (FIGS. 2–3 and 7–9) of carburetor 54 through a fuel line (not shown).

Figure 10:
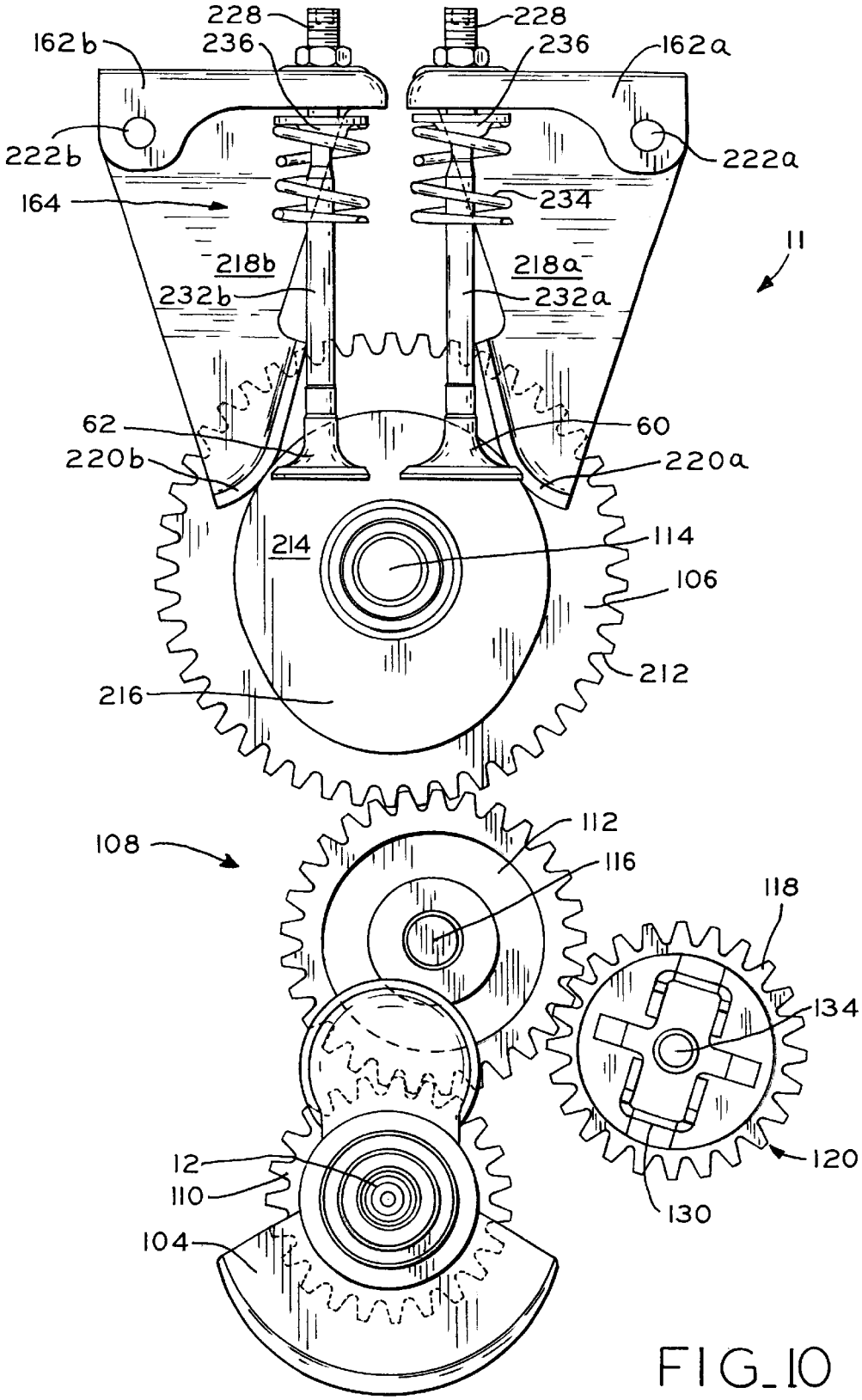
FIG. 10 is a top view of the drive train.
Figure 11:
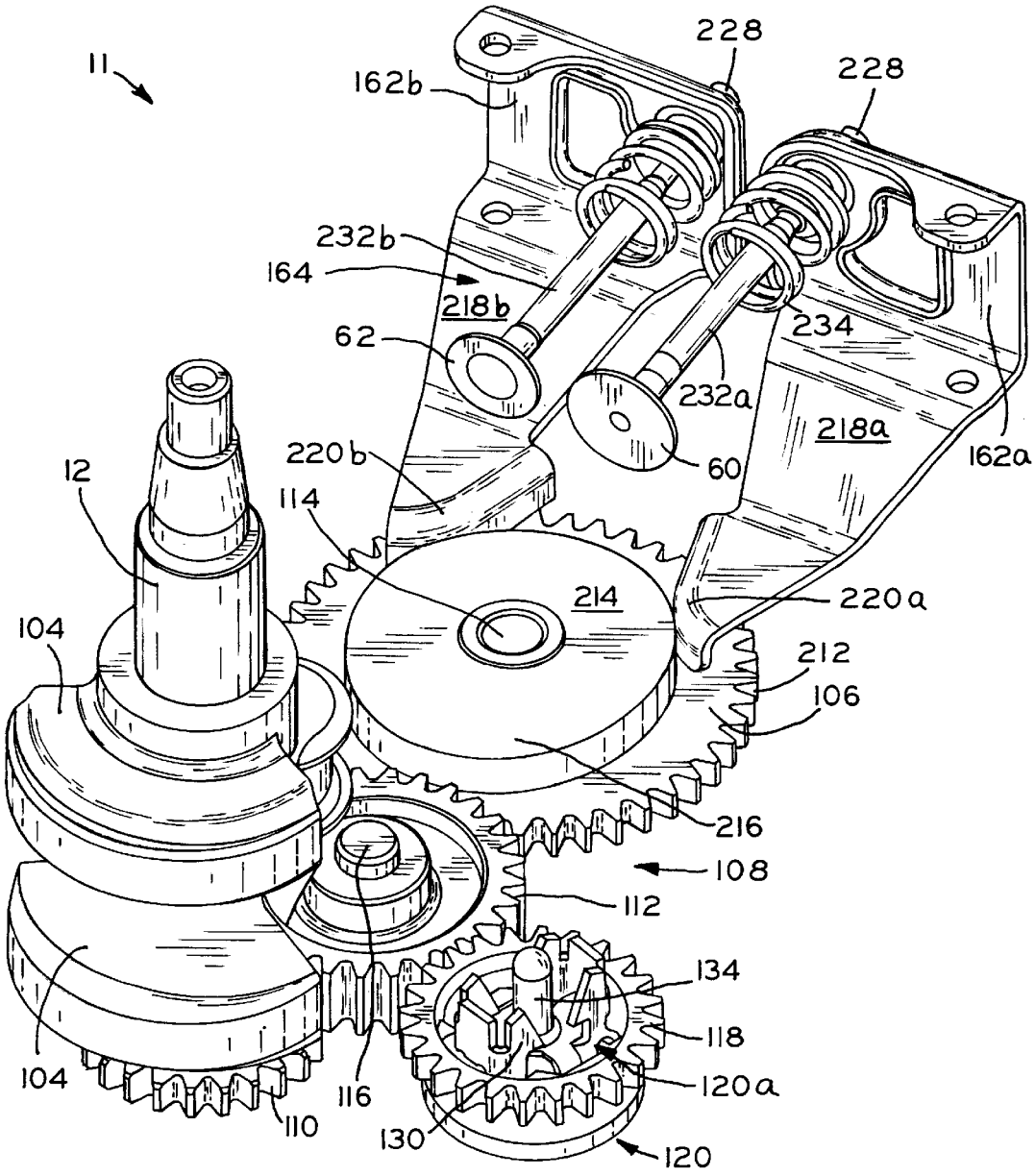
FIG. 11 is a perspective view of the drive train of FIG. 10.

Referring to FIG. 4, piston 92 is slidably received in cylinder bore 34 within cylinder block 32 and reciprocates along an axis $L_1$—$L_1$. Piston includes piston sealing rings 94 therearound, and together with cylinder head 36, defines combustion chamber 96 therebetween. Piston 92 is rotatably connected to connecting rod 98 by a coupling, shown in FIG. 4 as wrist pin 100. Connecting rod 98 is also operably connected to crankshaft 12 by a coupling at the interface of connecting rod 98 and crankshaft 12, shown in FIG. 4 as split cap 102 disposed between a pair of throws 104. As shown in FIGS. 4 and 10–11, crankshaft 12 drives cam gear 106 at half speed of crankshaft 12 through drive linkage 108. Drive linkage 108 includes drive gear 110 mounted on crankshaft 12, which in turn drives intermediate or idler gear 112, which in turn drives cam gear 106 in a timed driven relationship with crankshaft 12.

Cam gear 106 rotates about an axis $L_2$—$L_2$ perpendicular to axis $L_1$—$L_1$. Cam gear 106 is located within gear pocket 38, which is integral with cylinder block 32, and cam gear 106 is rotatably supported within gear pocket 38 on camshaft 114. Camshaft 114 is journalled in upper camshaft bearing 40, which is located within a wall of cylinder block 32 adjacent cylinder bore 34, and in lower camshaft bearing 42, which is located within a wall of gear pocket 38 opposite cylinder bore 34. It may further be seen from FIG. 4 that camshaft 114 and cam gear 106 are disposed in gear pocket 38 externally of cylinder head 36, with cam gear 106 disposed radially adjacent cylinder bore 34.

As shown in FIGS. 4 and 10–11, intermediate gear 112 is sized such as to engage drive gear 110 and cam gear 106, resulting in a 2:1 speed reduction between crankshaft and cam gear 106. Intermediate gear 112 is rotatably supported on an intermediate shaft 116 (FIGS. 10 and 11) carried in upper and lower intermediate shaft bearings (not shown in FIG. 4), disposed respectively in cylinder casing 20 and in intermediate shaft support 116 of mounting flange casing 30. Intermediate gear 112 may also be rotatably supported on a stationary stub shaft formed integral with either cylinder casing 20 or mounting flange casing 30. Drive gear 110, intermediate gear 112, governor/pump gear 118 (described below), and cam gear 106 may be formed of powder metal, injection molded plastic, or cast metal, for example.

Figure 12:
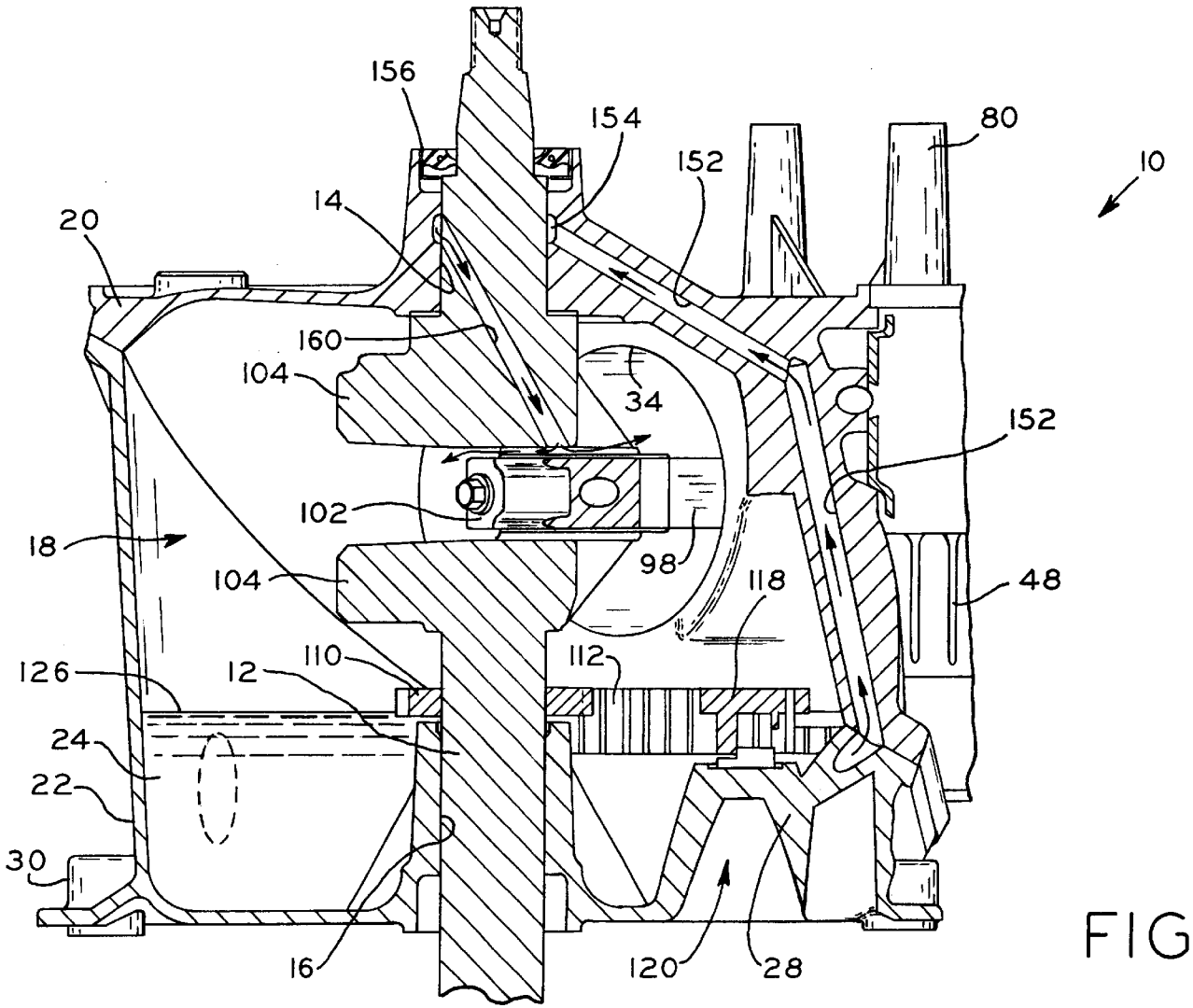
FIG. 12 is a sectional view taken along line 12—12 of FIG. 3, showing the oil passages in the crankcase and crankshaft.
Figure 13:
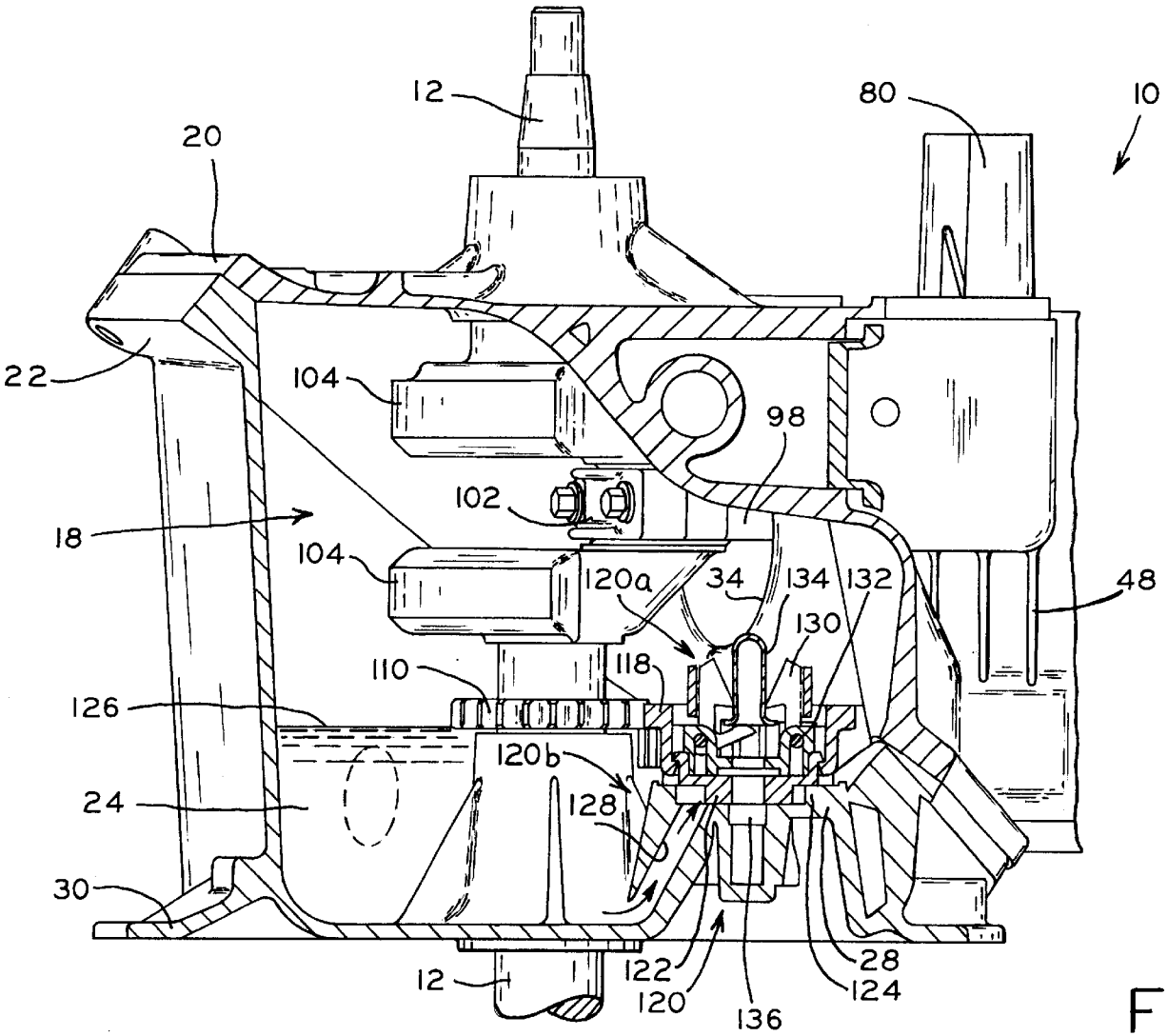
FIG. 13 is a sectional view taken along line 13—13 of FIG. 3, showing the oil inlet passage.
Figure 14:
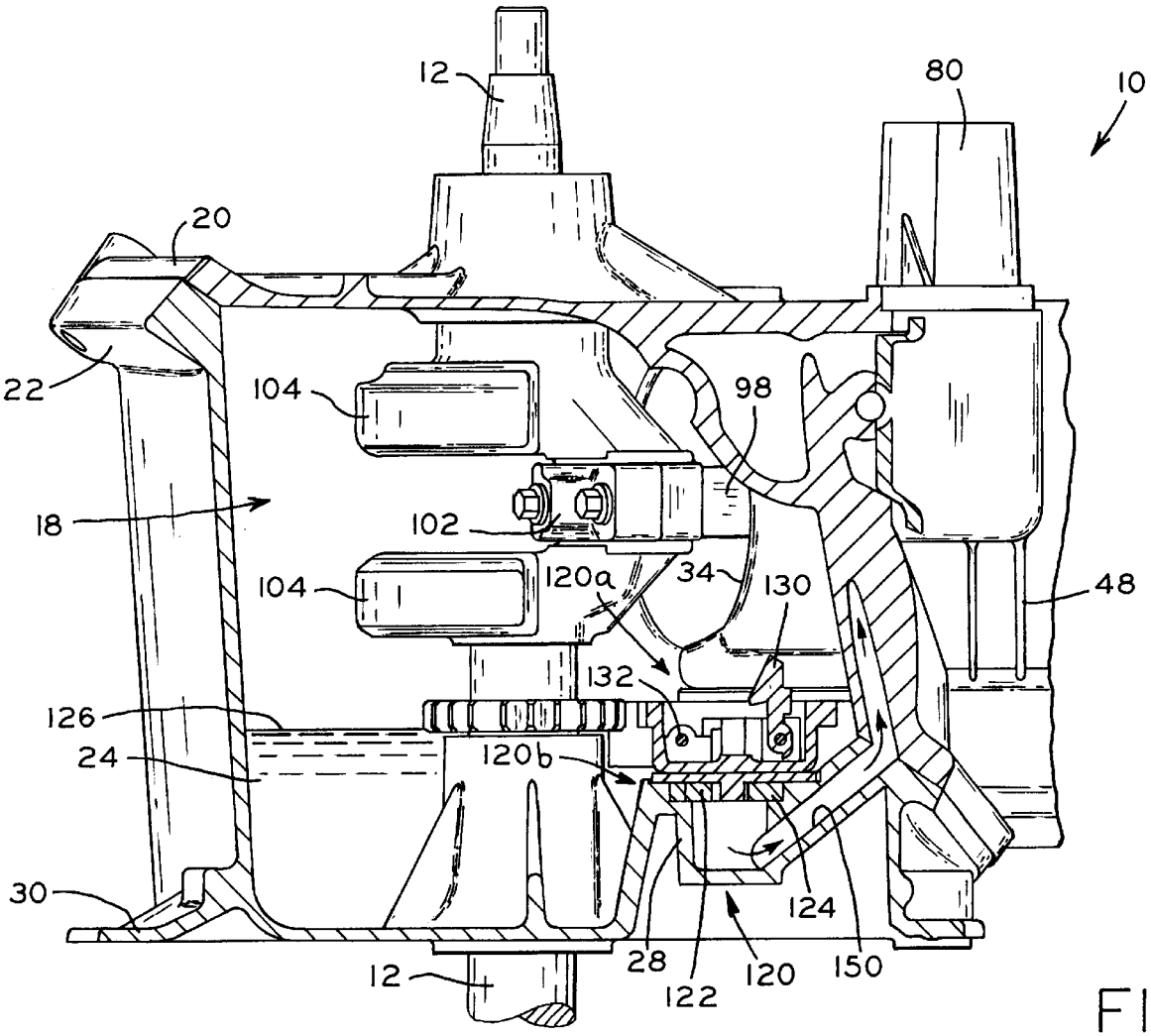
FIG. 14 is a sectional view taken alone line 14—14 of FIG. 3, showing the oil outlet passage.

Intermediate gear 112 drives a combination oil pump and governor assembly 120, shown in FIGS. 10–16, generally including governor portion **120*a* and oil pump portion 120*b*. Governor/pump gear 118 disposed around the periphery of oil pump and governor assembly 120, which meshes with and is driven by intermediate gear 112. As shown in FIGS. 13 and 14, governor/pump gear 118 includes inner rotor 122 which engages outer rotor 124 fixed within oil pump housing 28 to draw oil 126 from oil sump 24 through oil inlet passage 128 (FIG. 13), and to pump oil 126 to various locations in engine 10** via oil passageways, which are described below.

Governor portion **120*a* includes governor weights 130 rotatably mounted within governor/pump gear 118 on pins 132. Spool 134 reciprocates on spindle 136 on governor/pump gear 118, and is supported by governor weights 130. When governor/pump gear 118 is driven by drive train 11 above a predetermined speed, governor weights 130 swing outwardly under centrifugal force, pushing spool 134 upwardly to rotate governor arm 138 and governor shaft 140, which are shown in FIG. 16. As shown in FIGS. 1–3 and 7–8, and 16, governor shaft 140 is connected to carburetor 54 through linkage 142 including governor lever 144 and governor link 146, such that rotation of governor shaft 140 actuates throttle lever 148 on carburetor 54 to maintain the speed of engine 10**.

As shown in FIGS. 12–14, oil pump portion **120*b* of oil pump and governor assembly 118 draws oil 126 from oil sump 24 through oil inlet passage 128 in oil pump housing 28 (FIG. 13), and pumps oil through oil outlet passage 150 disposed in oil pump housing 28 and mounting flange casing 22 (FIG. 14). Oil outlet passage 150 communicates oil to cylinder oil passage 152 located within cylinder casing 20, which in turn communicates oil to crankshaft oil groove 154 disposed within upper crankshaft bearing 14 around crankshaft 12. Oil in crankshaft oil groove 154, which is under pressure from the pumping action of oil pump and governor assembly 120, aids in supporting and centering crankshaft 12 during the running of engine 10. Oil in crankshaft oil groove 154 is also forced therefrom to several locations under the pumping pressure from oil pump and governor assembly 120. A first portion of oil travels downwardly between crankshaft 12 and upper crankshaft bearing 14 to lubricate same, before dripping back into oil sump 24. A second portion of oil travels upwardly between crankshaft 12 and upper crankshaft bearing 14 to crankshaft/flywheel oil seal 156 to lubricate the interface between crankshaft 12 and flywheel 70, before passing through crankshaft/flywheel oil seal drain 158 back into crankcase 18. A third portion of oil travels through crankshaft oil passage 160, located in crankshaft 12, to lubricate the coupling interface between crankshaft 12 and connecting rod 98 at split cap 102, where oil is then splashed between throws 104 and into cylinder bore 34 beneath piston 92, before dripping back into oil sump 24**.

Additionally, drive gear 110, governor/pump gear 118, and other moving parts in crankcase 12 agitate oil 126 within oil sump 24 to create an oil mist, which, under the pressure generated by the reciprocation of piston 92, is forced through gear pocket 38 into rocker box 46 to lubricate rocker arms 162 and valve assembly 164. Upon condensation, oil may drip back into crankcase 18 through gear pocket 38. Additionally, oil splash created by the moving parts within crankcase 18 is propagated through gear pocket 38 by the movement of drive train 11 into rocker box 46, and then back into oil sump 24 therefrom.

Referring to FIGS. 1 and 6–8, air cleaner assembly 58 is shown, mounted to breather 168 and carburetor 54 of engine 10. Breather 168 includes breather chamber 170 integrally formed in cylinder casing 20. Breather chamber 168 is in communication with crankcase 18 through one-way breather valve 172, which includes disk valve seat 174 and disk valve 176 (FIG. 6). Breather cover 178 is mounted onto cylinder casing 20 by a bolt (not shown) inserted through mounting hole 180 of breather cover 178 and threadedly engaged in mounting post 182, which is integral with cylinder casing 20. Breather cover 178 encloses breather chamber 170, which is defined between breather cover 178 and cylinder casing 20. Breather cover 178 includes a plurality of indentations 184 projecting into breather chamber 170 to retain disk valve 176 onto disk valve seat 174 and prevent disk valve 176 from sticking to the inner surface of breather cover during operation of disk valve 176. Breather cover 178 also includes air cleaner tube opening 186.

Figure 7:
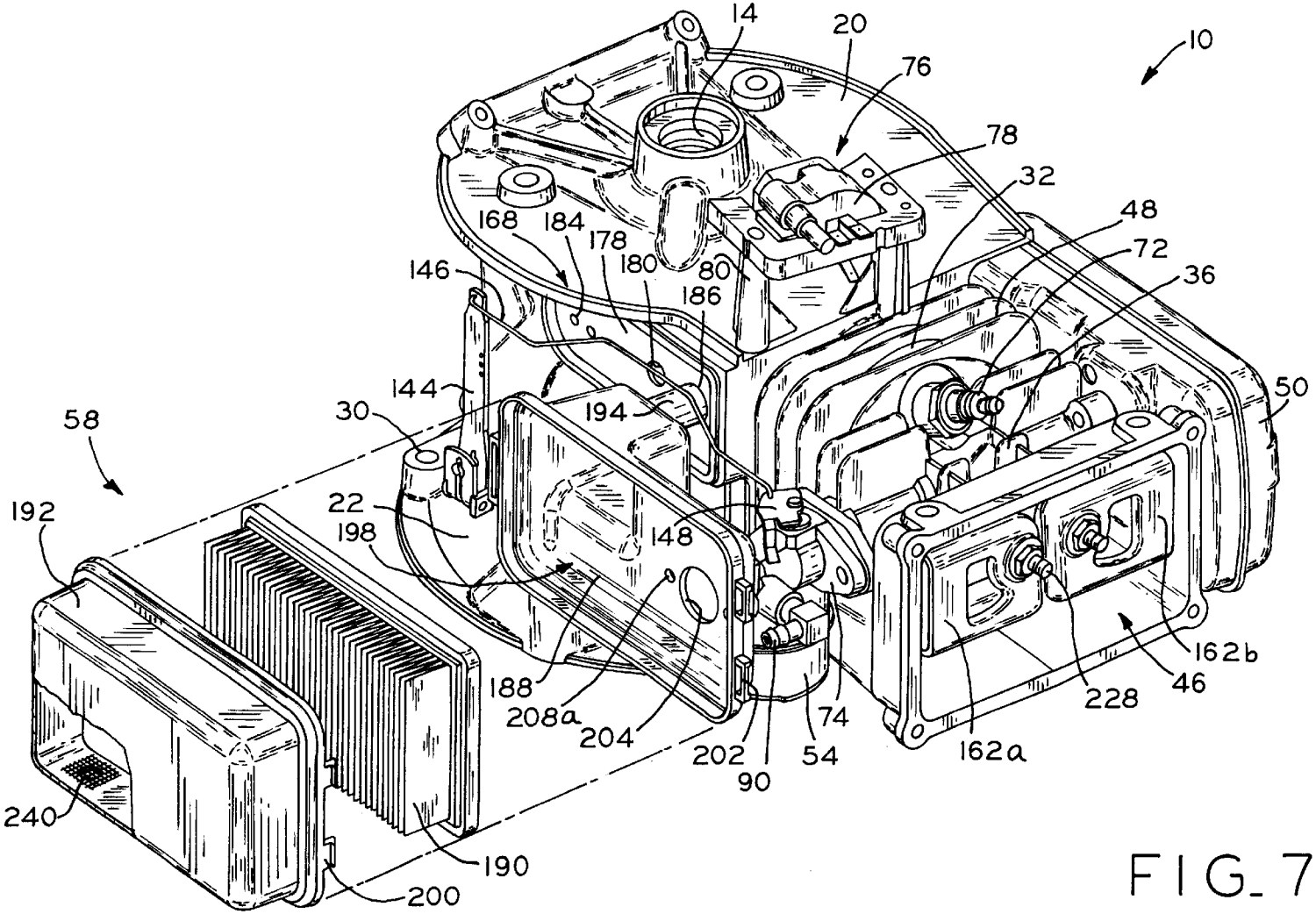
FIG. 7 is an isometric exploded view of the air cleaner assembly, showing the air cleaner body, filter, and cover.
Figure 8:
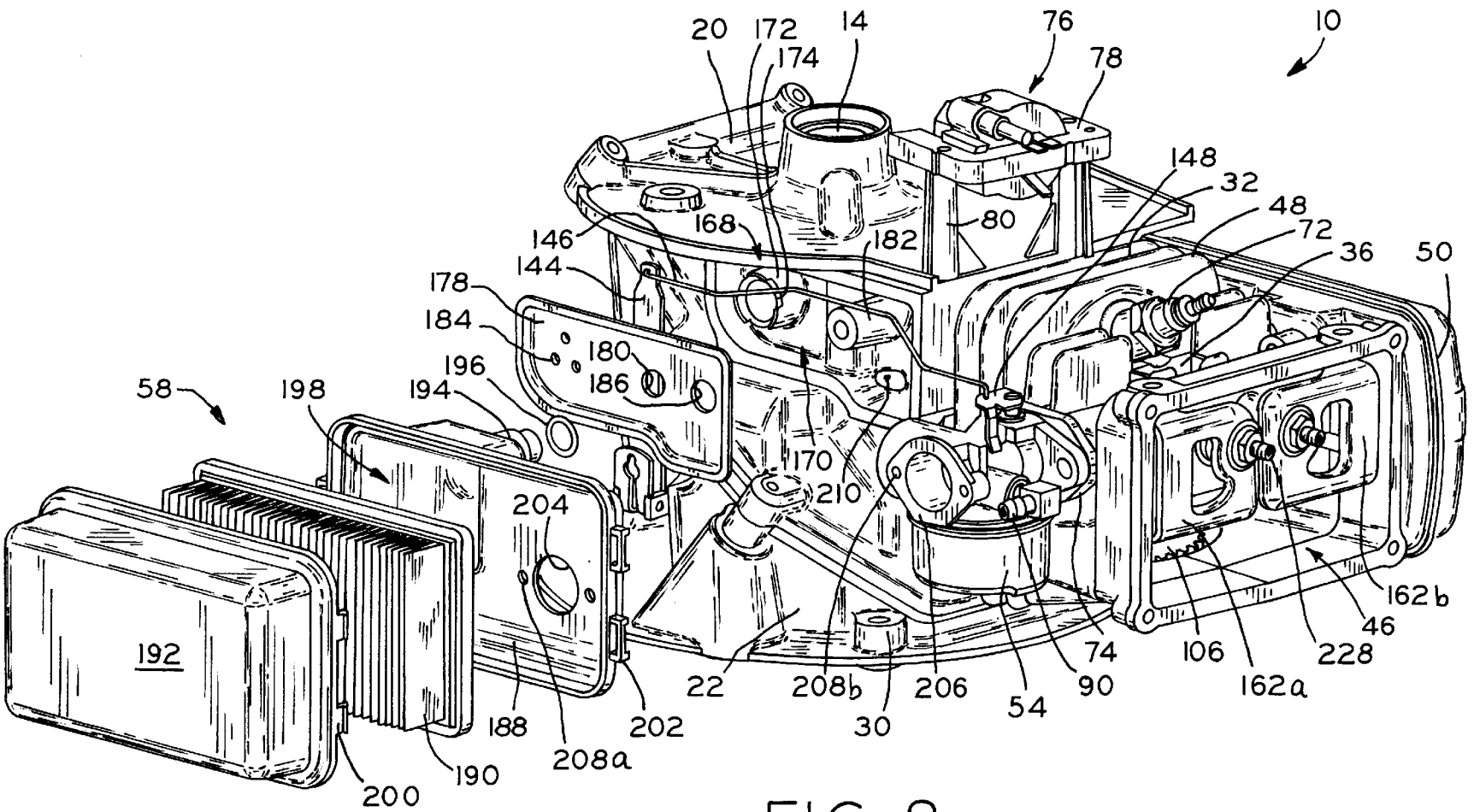
FIG. 8 is an isometric exploded view of the air cleaner assembly, showing the breather chamber, breather cover, O-ring, air cleaner body, filter, and cover.

Air cleaner assembly 58 includes air cleaner body 188, air filter 190, and air cleaner cover 192. Air cleaner body 188 includes an integrally molded or unitary air cleaner fitting 194 which fits through air cleaner tube opening 186 in breather cover 178 to communicate breather chamber 170 with air cleaner body 188. Air cleaner fitting 194 is shown in the FIGS. 1 and 6–8 in the shape of a tube, however, air cleaner fitting 194 may be formed in a variety of shapes. An O-ring 196, or other sealing member such as a gasket, for example, fits around air cleaner fitting 194 to provide a seal between air cleaner fitting 194 and breather cover 178. Air cleaner cover 192 is attached to air cleaner body 188 to define air cleaner chamber 198 therebetween, and includes a plurality of intake openings 240 (FIG. 7) on the underside thereof through which intake air is drawn into air cleaner chamber 198. Filter 190 is disposed within air cleaner chamber 198 to filter dust, dirt, oil and other matter from the intake air to prevent same from entering carburetor 54. Air cleaner cover 192 is detachably connected to air cleaner body 188, such as by engagement between resilient tabs 200 of air cleaner cover 192 into latches 202 of air cleaner body 188, as shown in FIGS. 7 and 8, or by other suitable means. Air cleaner body 188 additionally includes carburetor opening 204 to directly communicate air cleaner chamber 198 with carburetor 54.

As shown in FIGS. 7 and 8, air cleaner body 188 is mounted onto cylinder casing 20 in a one-step operation in which air cleaner fitting 194 is inserted through breather cover 178, and air cleaner body 188 is brought into alignment with the carburetor mounting flange 206. Air cleaner body 188 is then attached directly to carburetor mounting flange 206 by a pair of fasteners (not shown) inserted through fastener apertures 208*a* in air cleaner body 188 and through corresponding apertures 208*b* in carburetor mounting flange 206. Advantageously, the fitting of integral air cleaner fitting 194 of air cleaner body 188 through breather cover 178, as well as the direct communication between air cleaner body 188 and carburetor 54 eliminates the need for separate hoses communicating breather chamber 170 with air cleaner body 188 and/or air cleaner body 188 with carburetor 54, as well as hose fittings and hose clamps associated therewith, which are necessary in prior air cleaner assemblies.

During operation of engine 10, intake air is drawn into air cleaner chamber 198 through intake openings 240 in air cleaner cover 192, where the air is filtered by filter 190 before passing into carburetor 54 for mixture with fuel therein. Additionally, blow-by gases, which pass from combustion chamber 96 around piston sealing rings 94 and into crankcase 18 during the compression stroke of piston 92, are vented into breather chamber 170 through one-way breather valve 172, and communicated into air cleaner chamber 198 and back into carburetor 54. In this fashion, engine 10 recirculates blow-by gasses from crankcase 18 back into carburetor 54 to reduce emissions from engine 10. Oil mist passing through one-way breather valve 172 may condense in breather chamber 170, and is then returned to crankcase 18 by draining through oil drain 210.

As shown in FIGS. 4 and 10–11, cam gear 106 has integrally formed teeth 212 around an outer periphery thereof, and includes an integral cam lobe 214. Alternatively, cam lobe 214 may be formed separately from cam gear 106 and mounted on cam gear 106 for rotation therewith. Cam lobe 214 includes thickened portion 216 for actuating cam follower arms 218*a*, 218*b*. As may be seen in FIG. 11, cam follower arms 218*a*, 218*b* are integral with rocker arms 162*a*, 162*b*, and terminate in cam follower portions 220*a*, 220*b* which engage cam lobe 214. More specifically, cam follower portions 220*a*, 220*b* engage an upper portion of cam lobe 214 at respective locations thereon which are located in gear pocket 38 and spaced opposite of crankshaft 12. As may be seen in FIG. 4, cam follower arms 218*a*, 218*b* extend into gear pocket 38 at an angle with respect to cam gear 106, while cam follower portions 220 are disposed within gear pocket 38 and are substantially parallel to cam gear 106. Cam follower portions 220*a*, 220*b* may optionally take the form of rollers.

Figure 9:
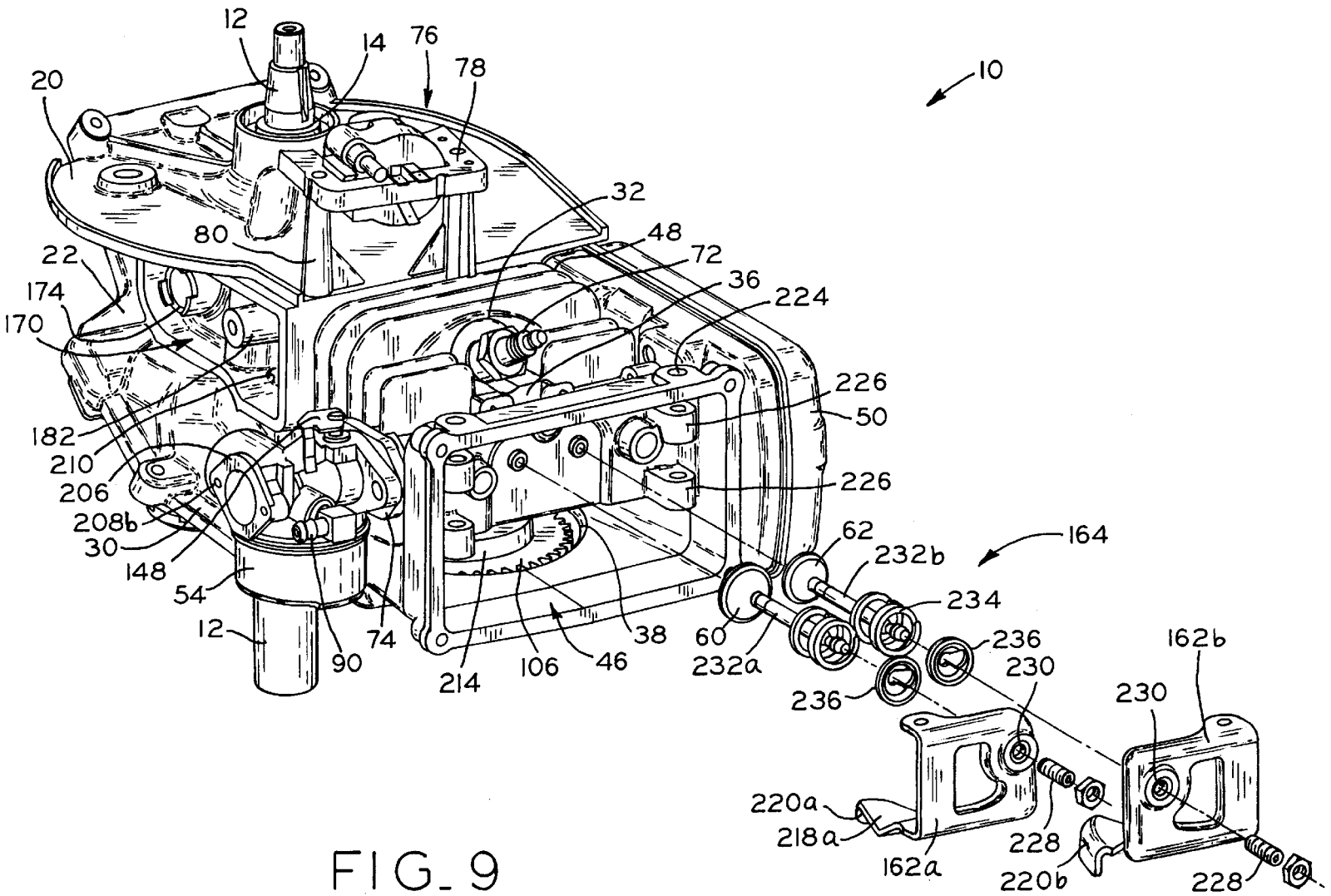
FIG. 9 is an isometric exploded view of part of the cylinder head, showing the rocker arms, valve stems, and other valve components.

Referring to FIGS. 4, 6 and 9, rocker arms 162*a*, 162*b* are pivotally mounted for rocking motion on rocker arm pivot shafts 222*a*, 222*b* for rotation about a pair of axes perpendicular to axis $L_1$–$L_1$. Rocker arm pivot shafts 222*a*, 222*b* are received through apertures 224 in cylinder head 36, and are rotatably carried in bosses 226 integral with cylinder head 36. Lash adjusting screws 228 are fixed within apertures 230 in rocker arms 162*a*, 162*b* and abut valve stem 232*a*, 232*b*. Valve springs 234 are coiled about valve stems 232*a*, 232*b* under compression between cylinder head 36 and valve keepers 236, and bias intake and exhaust valves 60, 62 against valve seats 238.

The operation of engine 10 will be explained with primary reference to FIGS. 10 and 11. As cam gear 106 is driven, thickened portion 216 of cam lobe 214 periodically rocks cam follower arms 218*a* and 218*b*, causing cam follower arms 218*a* and 218*b* to rotate with rocker arm shafts 222*a* and 222*b*. Rotation of rocker arms 162*a*, 162*b* periodically actuates intake valve 60 and exhaust valve 62, respectively.

Drive train 11 operates on a conventional 4-stroke cycle, including the steps of intake, compression, power and exhaust. Referring to FIGS. 6, 10 and 11, on the intake stroke, cam lobe 214 engages cam follower arm 218*a* to rotate cam follower arm 218*a* and rocker arm 162*a* to open intake valve 60, allowing a fuel/air mixture from carburetor 54 into combustion chamber 96 (FIGS. 4 and 6) through intake port 56. On the compression and power strokes, cam follower arms 218*a*, 218*b* are not rotated by cam lobe 214, and valve springs 234 bias rocker arms 162*a*, 162*b* such that intake valve 60 and exhaust valve 62 are closed. On the exhaust stroke, cam lobe 214 engages cam follower arm 218*b* to rotate cam follower arm 218*b* and rocker arm 162*b* to open exhaust valve 62, venting exhaust gas out of combustion chamber 96 through exhaust port 52 and muffler 50.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An internal combustion engine, comprising:

a crankshaft, connecting rod, and piston assembly, said crankshaft disposed substantially vertically, said piston reciprocating within a cylinder bore in a cylinder block connected to a cylinder head;

a cam gear supported for rotation externally of said cylinder head, said cam gear having at least one cam lobe thereon for rotation with said cam gear;

drive linkage between said crankshaft and said cam gear; and a pair of rocker arms mounted for rocking motion in said cylinder head for actuating a pair of valves, each said rocker arm including a cam follower arm extending therefrom, said cam follower arms engaging said at least one cam lobe.

2. The engine of claim 1, wherein said cam gear is supported for rotation within said cylinder block about a first axis, and said piston reciprocates along a second axis perpendicular to said first axis.

3. The engine of claim 1, wherein said cam gear is disposed substantially adjacent said cylinder bore.

4. The engine of claim 1, wherein said cam gear is disposed in a gear pocket disposed radially adjacent said cylinder bore.

5. The engine of claim 4, wherein said cam gear is rotatably supported on a shaft, said shaft located within said gear pocket.

6. The engine of claim 4, wherein said cam follower arms extend into said gear pocket, said cam follower arms engaging said at least one cam lobe at respective locations within said gear pocket and spaced opposite said crankshaft.

7. The engine of claim 1, wherein said drive linkage comprises:

a drive gear mounted on said crankshaft; and an intermediate gear intermeshing with said drive gear and said cam gear.

8. An internal combustion engine, comprising:

a cylinder block connected to a cylinder head, said cylinder block including a cylinder bore and a gear pocket therein, said gear pocket disposed radially adjacent said cylinder bore and external of said cylinder head;

a crankshaft, connecting rod, and piston assembly, said crankshaft disposed substantially vertically, said piston reciprocating along a first axis within said cylinder bore;

a cam gear mounted for rotation in said gear pocket in timed driven relationship with said crankshaft, said cam gear rotating about an axis of rotation perpendicular to said piston axis;

at least one cam lobe on said cam gear for rotation therewith; and a pair of rocker arms mounted for rocking motion in said cylinder head for actuating a pair of valves, said rocker arms including cam follower arms extending into said gear pocket and in engagement with said at least one cam lobe.

9. The engine of claim 8 further comprising:

a drive gear mounted on said crankshaft; and an intermediate gear engaging said drive gear and said cam gear, resulting in a 2:1 speed reduction between said crankshaft and said cam gear.

10. The engine of claim 8, wherein said cam follower arms engage said at least one cam lobe at respective locations which are spaced on a side of said at least one cam lobe which is located opposite said crankshaft.

11. An internal combustion engine, comprising:

a crankshaft, connecting rod, and piston assembly, said crankshaft disposed along a first axis, said piston reciprocating along a second axis within a cylinder bore in a cylinder block connected to a cylinder head;

a cam gear supported for rotation externally of said cylinder head about a third axis, said cam gear having at least one cam lobe thereon for rotation with said cam gear, wherein said first, second, and third axes are disposed in a common plane;

drive linkage between said crankshaft and said cam gear; and a pair of rocker arms mounted for rocking motion in said cylinder head for actuating a pair of valves, each said rocker arm including a cam follower arm extending therefrom, said cam follower arms engaging said at least one cam lobe.

12. The engine of claim 11, wherein said cylinder block includes a gear pocket disposed radially adjacent said cylinder bore, said cam gear supported for rotation within said gear pocket.

13. The engine of claim 12, wherein said cam gear is rotatably supported on a shaft, said shaft located within said gear pocket.

14. The engine of claim 12, wherein said cam follower arms extend into said gear pocket, said cam follower arms engaging said at least one cam lobe at respective locations within said gear pocket spaced opposite said crankshaft.

15. An internal combustion engine,comprising:

a crankshaft, connecting rod, and piston assembly, said piston reciprocating within a cylinder bore in a cylinder block connected to a cylinder head, said cylinder bore having an upper end opposite said crankshaft;

a cam gear disposed within said cylinder block externally of said cylinder head and adjacent said cylinder block, at least a portion of said cam gear extending outwardly from said crankshaft beyond said upper end of said cylinder bore, said cam gear having at least one cam lobe thereon for rotation with said cam gear;

drive linkage between said crankshaft and said cam gear; and a pair of rocker arms mounted for rocking motion in said cylinder head for actuating a pair of valves, each said rocker arm including a cam follower arm extending therefrom, said cam follower arms engaging said at least one cam lobe.

16. The engine of claim 15, wherein said crankshaft is disposed substantially vertically.

17. The engine of claim 15, wherein said cylinder block includes a gear pocket disposed radially adjacent said cylinder bore, said cam gear supported for rotation within said gear pocket.

18. An internal combustion engine, comprising:

a crankshaft, connecting rod, and piston assembly, said piston reciprocating within a cylinder bore in a cylinder block connected to a cylinder head;

a crankcase including a first portion connected to said cylinder block and a second portion connected to said first portion along a plane disposed at an angle relative to said crankshaft, wherein opposite ends of said crankshaft are respectively supported by said first and second portions of said crankcase;

a cam gear supported for rotation within said cylinder block externally of said cylinder head, said cam gear having at least one cam lobe thereon for rotation with said cam gear;

drive linkage between said crankshaft and said cam gear; and a pair of rocker arms mounted for rocking motion in said cylinder head for actuating a pair of valves, each said rocker arm including a cam follower arm extending therefrom, said cam follower arms engaging said at least one cam lobe.

19. The engine of claim 18, wherein said crankshaft is disposed substantially vertically.

20. An internal combustion engine, comprising:

a crankshaft, connecting rod, and piston assembly, said piston reciprocating within a cylinder bore in a cylinder block having an integral cylinder head;

a gear pocket within said cylinder block, said gear pocket disposed radially adjacent said cylinder bore;

a cam gear supported for rotation within said gear pocket externally of said cylinder head, said cam gear having at least one cam lobe thereon for rotation with said cam gear;

drive linkage between said crankshaft and said cam gear; and a pair of rocker arms mounted for rocking motion in said cylinder head for actuating a pair of valves, each said rocker arm including a cam follower arm extending therefrom, said cam follower arms engaging said at least one cam lobe.

21. The engine of claim 20, wherein said crankshaft is disposed substantially vertically.

22. An internal combustion engine, comprising:

a crankshaft, connecting rod, and piston assembly, said piston reciprocating within a cylinder bore in a cylinder block connected to a cylinder head;

at least one cam lobe supported for rotation externally of said cylinder head about an axis disposed perpendicular to said cylinder bore, said axis intersecting said cylinder bore proximate an outer end of said cylinder bore which is disposed opposite said crankshaft;

drive linkage between said crankshaft and said cam lobe; and a pair of rocker arms mounted for rocking motion in said cylinder head for actuating a pair of valves, each said rocker arm including a cam follower arm extending therefrom, said cam follower arms engaging said at least one cam lobe.

23. The engine of claim 22, wherein said crankshaft is disposed substantially vertically.

* * * * *